US006951600B2

(12) United States Patent
Santoyo

(10) Patent No.: US 6,951,600 B2
(45) Date of Patent: Oct. 4, 2005

(54) EDGE PROTECTOR FOR ELECTROWINNING ELECTRODE

(76) Inventor: Manuel G. Santoyo, 6060 E. River Rd., Tucson, AZ (US) 85750

( * ) Notice: Subject to any disclaimer, the term of this patent is extended or adjusted under 35 U.S.C. 154(b) by 526 days.

(21) Appl. No.: 10/274,188

(22) Filed: Oct. 18, 2002

(65) Prior Publication Data

US 2004/0074767 A1 Apr. 22, 2004

(51) Int. Cl.[7] ..... C25D 1/10
(52) U.S. Cl. ..... 204/281; 204/279
(58) Field of Search ..... 204/279, 281

(56) References Cited

U.S. PATENT DOCUMENTS 4,207,147 A * 6/1980 Babin ..... 204/281
5,690,798 A * 11/1997 Alexander et al. ..... 204/279
6,193,862 B1 * 2/2001 Cutmore et al. ..... 204/281
6,274,012 B1 * 8/2001 Santoyo ..... 204/279
6,551,475 B2 * 4/2003 Dwyer et al. ..... 204/281
6,746,581 B2 * 6/2004 Ebert ..... 204/279

* cited by examiner

*Primary Examiner*—Bruce F. Bell
(74) *Attorney, Agent, or Firm*—Quarles & Brady Streich Lang LLP

(57) ABSTRACT

A one-piece edge strip to be mounted on the bottom edge of a cathode used in electrolysis has a channel running longitudinally of the edge strip. The channel is designed to receive the bottom edge of the cathode. The edge strip is provided with a receptacle at either end of the channel, and each receptacle can accommodate an end portion of an edge strip mounted on a side edge of the cathode.

19 Claims, 5 Drawing Sheets

EDGE PROTECTOR FOR ELECTROWINNING ELECTRODE

BACKGROUND OF THE INVENTION

1. Field of the Invention

The invention relates to the shielding of the edges of electrodes used in electrolytic processes.

2. Description of the Prior Art

Electrowinning is an electrolytic process in which metallic ions, e.g., copper ions, are recovered from an electrolyte using anodes and cathodes in the form of generally rectangular plates. A large number of anodes and a large number of cathodes are suspended in the electrolyte vertically with the anodes and the cathodes alternating. The cathodes are typically made of titanium, stainless steel or a copper alloy, and the metallic ions deposit on the cathodes and coat them with sheets of pure metal. When the deposited sheets reach a certain thickness, the cathodes are removed from the electrolyte and the sheets stripped from the cathodes.

If deposition is allowed to occur at the edges of a cathode, metallic bridges are formed between the deposited sheets on either side of the cathode. These metallic bridges, which wrap around the edges of the cathode, make it difficult to strip the deposited sheets without damaging the sheets and/or the cathode.

To alleviate this problem, nonconductive strips known as edge strips or protector strips are placed over the submerged bottom and side edges of the cathode. These edge strips, which have identical cross sections, not only inhibit the formation of metallic bridges but also function to prevent direct contact between the cathode and the adjacent anodes.

At the lower corners of a cathode, the edge strips on the sides of the cathode define junctions with the edge strip at the bottom of the cathode. To prevent the penetration of electrolyte into, and an accompanying deposition of metal around, the junctions, U.S. Pat. No. 5,690,798 places a corner protector over each of the junctions. Each corner protector has two short legs which are perpendicular to one another, and each leg is provided with a channel having a cross section which matches the cross sections of the edge strips. One channel of each corner protector receives the adjacent end of the edge strip on the adjoining side of the cathode while the other channel receives the adjacent end of the edge strip on the bottom of the cathode. Each corner protector further has a cutout which runs between the free ends of the two legs of the corner protector and accommodates an adjoining portion of the cathode.

To prevent electrolyte from seeping into a corner protector, it is necessary to seal around the free end of each leg and along the two edges of the cutout. This rather extensive sealing is time-consuming.

SUMMARY OF THE INVENTION

It is an object of the invention to decrease the sealing time for electrode protectors.

The preceding object, as well as others which will become apparent as the description proceeds, are achieved by the invention.

One aspect of the invention resides in a protective sheath or protector for use on an electrode having a first edge and a second edge which are transverse to one another. The protective sheath comprises a body including an elongated first section having a channel which extends longitudinally of the first section and is designed to receive at least a major part of the first edge of the electrode. The body further includes a second section which is of one piece with the first section and defines a receptacle for an end portion of another sheath or protector designed to receive at least a major part of the second edge of the electrode.

In accordance with the invention, a receptacle or receiver for an end portion of a first sheath or protector is of one piece with a second sheath or protector. Consequently, in order to close the receptacle, it is necessary to seal only the location at which the first sheath enters the receptacle. This allows the sealing time to be reduced.

Another aspect of the invention resides in an arrangement for use in electrolysis. The arrangement comprises an electrode having a first edge and a second edge which are transverse to one another, and a first sheath mounted on the first edge and receiving at least a major part thereof. The arrangement additionally comprises a second sheath mounted on the second edge of the electrode and including an elongated first section having a channel which extends longitudinally of the first section and receives at least a major part of the second edge. The second sheath further includes a second section of one piece with the first section and defining a receptacle which receives an end portion of the first sheath.

An additional aspect of the invention resides in a method of making a protective sheath for an electrode having a first edge and a second edge which are transverse to one another. The method comprises the steps of providing a body, forming a channel in the body designed to receive at least a major part of the first edge of the electrode, and forming a receptacle in the body for an end portion of another sheath designed to receive at least a major part of the second edge of the electrode.

The step of forming the receptacle preferably involves providing the receptacle with an interior having a cross section which is substantially complementary to the cross section of a sheath designed to receive at least a major part of the second edge of the electrode.

The electrode may have an additional edge which also runs transverse to the first edge and the method can here comprise the step of forming an additional receptacle in the body for an end portion of an additional sheath designed to receive at least a major part of the additional edge of the electrode.

One more aspect of the invention resides in a method of preparing an electrode for use in electrolysis, the electrode having a first edge and a second edge which are transverse to one another. The preparing method comprises the steps of placing a first sheath on the first edge so that the first sheath receives at least a major part of such edge, placing a second sheath on the second edge so that the second sheath receives at least a major part of the second edge, and inserting a selected end portion of the first sheath in the second sheath.

The inserting step may include introducing the selected end portion of the first sheath into a receptacle having a cross section which is substantially complementary to the cross section of such end portion.

As mentioned earlier, the electrode can have an additional edge which runs transverse to the second edge thereof. The preparing method may here further comprise the steps of placing an additional sheath on the additional edge so that the additional sheath receives at least a major part of the additional edge, and inserting an end portion of the additional sheath in the second sheath.

Additional features and advantages of the invention will be forthcoming from the following detailed description of preferred embodiments when read in conjunction with the accompanying drawings.

DESCRIPTION OF THE PREFERRED EMBODIMENTS

Figure 1:
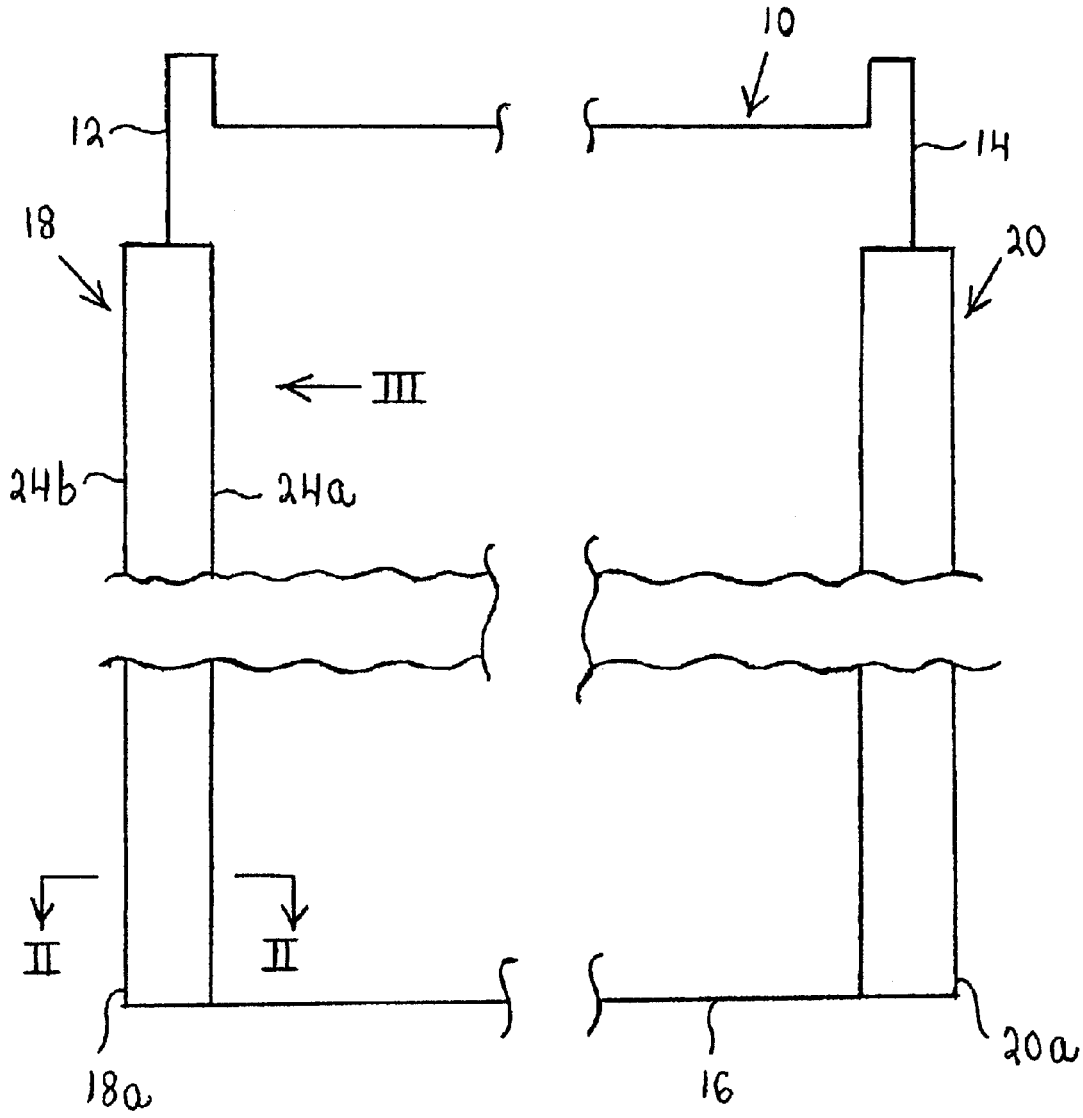
FIG. 1 is a fragmentary elevational view of an electrode having two edges which are provided with edge protectors.

Referring to FIG. 1, the numeral 10 identifies an electrode for use in electrolytic processes including but not limited to electrowinning, As indicated earlier, electrowinning is the recovery of metal, e.g., pure copper, from an electrolytic solution or electrolyte. The electrode 10 is here assumed to be a cathode and, in operation, the cathode 10 is suspended in an electrolyte as part of an array of alternating cathodes and anodes.

The cathode 10 may be made of any material, such as a copper alloy, titanium or stainless steel, traditionally employed for electrolytic processes. The cathode 10 has a pair of opposed, straight side edges 12 and 14 as well as a straight bottom edge 16 which spans the side edges 12,14, and the side edges 12,14 are vertical during use while the bottom edge 16 is horizontal. When the cathode 10 is suspended in an electrolyte, the cathode bottom edge 16 and all but the uppermost portions of the cathode side edges 12,14 are submerged. The lengths of the submerged portions of the cathode side edges 12,14 greatly exceed the lengths of the nonsubmerged portions. Thus, each of the submerged portions constitutes the major part of the respective cathode side edge 12,14.

The submerged portion of the cathode side edge 12 is provided with an electrically nonconductive sheath or covering 18 whereas the submerged portion of the cathode side edge 14 is provided with an electrically nonconductive sheath or covering 20. The sheaths 18,20, which can be made of plastic, may be constituted by conventional edge strips or edge protectors and function to prevent deposition at the cathode side edges 12,14. The sheaths 18,20, which will be referred to as side edge strips, are here assumed to be identical and have the same cross-sectional shape and the same cross-sectional area. A cross section of the side edge strip 18 is shown in FIG. 2.

Figure 2:
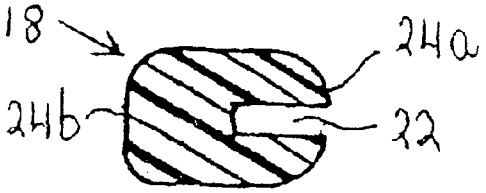
FIG. 2 is a sectional view of one of the edge protectors of FIG. 1 as seen in the direction of the arrows II—II of FIG. 1.
Figure 3:
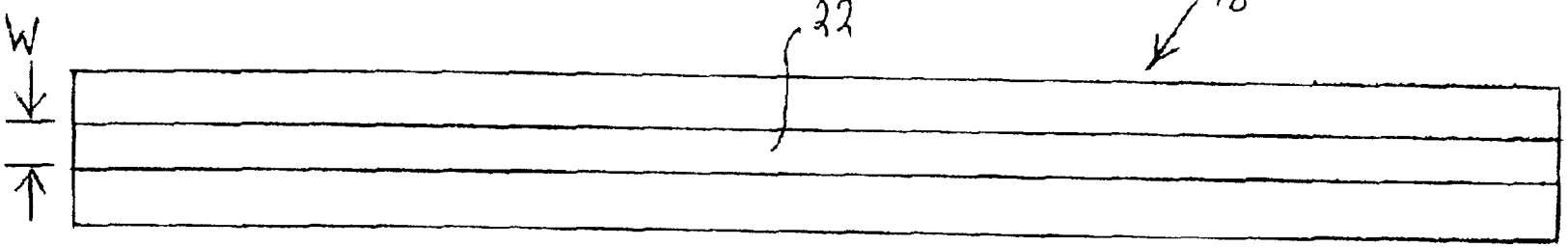
FIG. 3 is a plan view of the edge protector of FIG. 2 as seen in the direction of the arrow III of FIG. 1.

Considering FIG. 3 together with FIGS. 1 and 2, it can be seen that the side edge strip 18 is elongated meaning that the length of the side edge strip 18 is a multiple of the width and thickness of the side edge strip 18. The length of the side edge strip 18 is at least equal to, and preferably exceeds, the length of the submerged portion of the cathode side edge 12. Hence, the edge strip 18 extends along at least the major part of the cathode side edge 12.

The side edge strip 18 is provided with a channel or slot 22 which runs longitudinally, and preferably extends along the entire length, of the side edge strip 18. The channel 22 is designed to receive the submerged portion of the cathode side edge 12, and the width W of the channel 22 is equal or approximately equal to the thickness of the cathode 10. The width W is advantageously selected such that the cathode side edge 12 is frictionally gripped by the side edge strip 18.

The side edge strip 18 has a side 24*a* which faces the side edge strip 20 during use and an opposite side 24*b* which faces away from the side edge strip 20 during use. The channel 22 is open at the side 24*a*, and the channel 22 extends partway from the side 24*a* to the opposite side 24*b* so that the channel 22 is closed at the side 24*b*. The channel 22 can be open at either end of the side edge strip 18.

The side edge strip 18 has a lower end portion 18*a* in the region of the corner defined by the side edge 12 and the bottom edge 16 of the cathode 10. Likewise, the side edge strip 20 has a lower end portion 20*a* in the region of the corner defined by the side edge 14 and the bottom edge 16 of the cathode 10.

Current practice is to place an edge strip of the same design as the side edge strips 18,20 on the submerged bottom edge 16 of the cathode 10. One end of the bottom edge strip abuts and defines a junction with the lower end portion 18*a* of the side edge strip 18 while the other end of the bottom edge strip abuts and defines a junction with the lower end portion 20*a* of the side edge strip 20. To prevent electrolyte from penetrating the junctions, a corner protector is positioned over each junction. Each corner protector has two short legs which are perpendicular to one another, and each leg is formed with a channel having a cross section which matches that of the bottom edge strip and the side edge strips 18,20. One of the corner protectors receives the lower end portion 18*a* of the side edge strip 18 as well as an end portion of the bottom edge strip. The second corner protector receives the lower end portion 20*a* of the side edge strip 20 and the other end portion of the bottom edge strip.

Each corner protector is further provided with a cutout which runs between the free ends of the respective legs. The cutouts accommodate portions of the cathode 10 adjacent to the junctions between the bottom edge strip and the side edge strips 18,20.

When the lower end portions 18*a*,20*a* of the side edge strips 18,20, as well as the end portions of the bottom edge strip, have been inserted in the legs of the corner protectors, the areas around the free ends of the legs are sealed as are the areas along the edges of the cutouts. This sealing operation is necessary to prevent electrolyte from seeping into the corner protectors. However, the rather extensive sealing is time-consuming.

An object of the invention is to decrease the sealing time.

Figure 4:
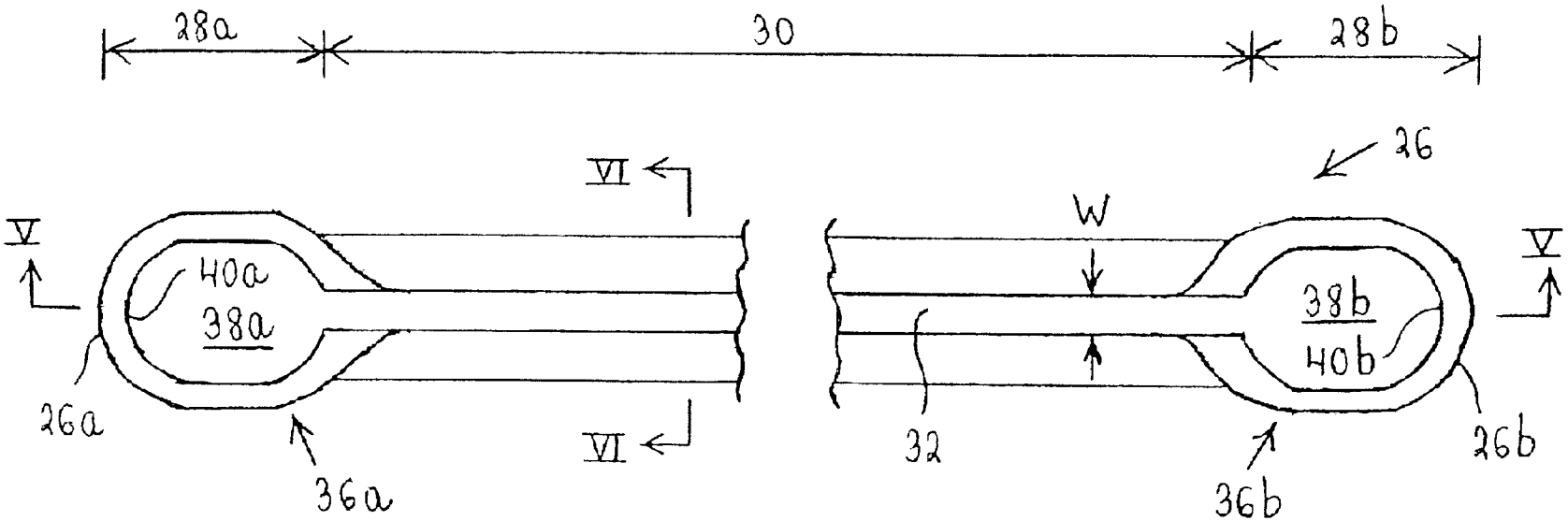
FIG. 4 is a plan view of another edge protector.
Figure 5:
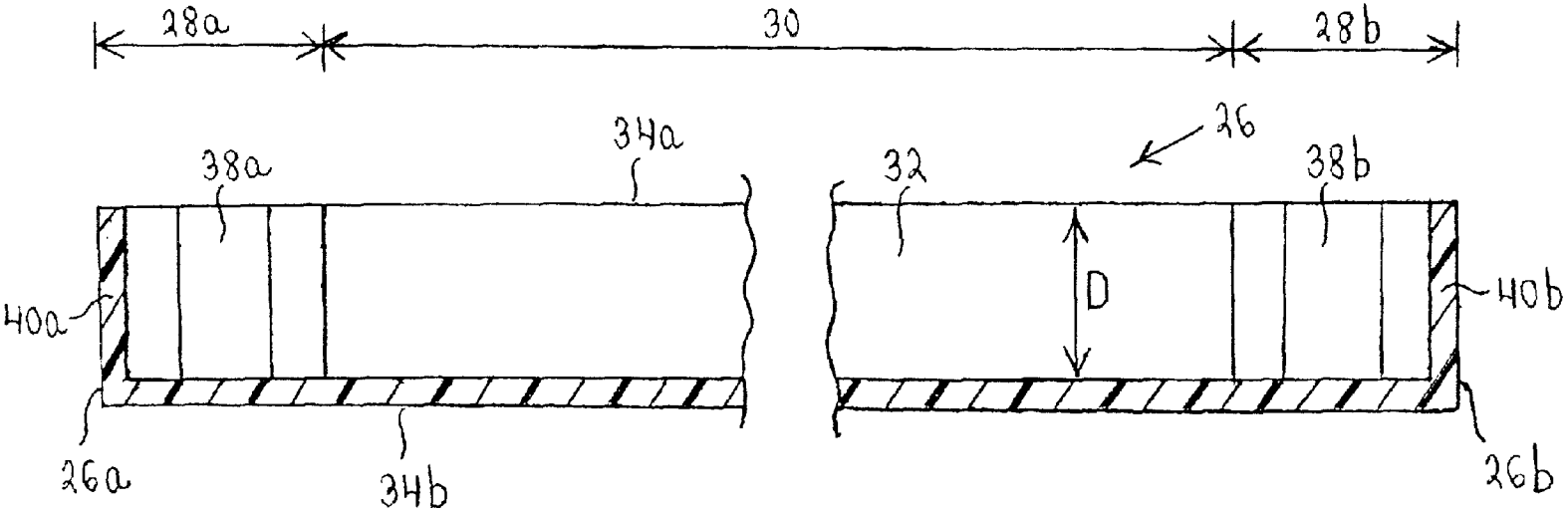
FIG. 5 is a sectional view of the edge protector of FIG. 4 as seen in the direction of the arrows V—V of FIG. 4.
Figure 6:
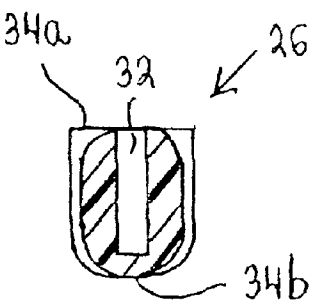
FIG. 6 is a sectional view of the edge protector of FIG. 4 as seen in the direction of the arrows VI—VI of FIG. 4.

In accordance with a preferred embodiment of the invention, this is accomplished by replacing the conventional bottom edge strip with the electrically nonconductive sheath or covering 26 illustrated in FIGS. 4, 5 and 6.

The sheath or covering 26, which can be made of the same material as the side edge strips 18,20, is an elongated, strip-like, one-piece body having two ends 26*a* and 26*b*. The sheath or covering 26, which will be referred to as the bottom edge strip, includes an end section 28*a* at the end 26*a*, an end section 28*b* at the end 26*b* and a central or middle section 30 between the end sections 28*a*,28*b*. The central section 30 spans the end sections 28*a*,28*b* and is designed to run along at least the major part of the bottom edge 16 of the cathode 10. The length of the central section 30 is equal or approximately equal to the distance between the side edge strips 18,20.

The central section 30 is provided with a channel or slot 32 which runs longitudinally, and preferably extends along the entire length, of the central section 30. The channel 32 is designed to receive the portion of the cathode bottom edge 16 between the side edge strips 18,20, and the width W of the channel 32 is equal or approximately equal to the thickness of the cathode 10. The width W of the channel 32 is advantageously selected such that the cathode bottom edge 16 is frictionally gripped by the bottom edge strip 26.

The bottom edge strip 26 has a side 34*a* which faces up during use and an opposite side 34*b* which faces down during use. The channel 32 is open at the side 34*a*, and the channel 32 extends partway from the side 34*a* to the opposite side 34*b* so that the channel 32 is closed at the side 34*b*.

The end sections 28*a*,28*b* of the bottom edge strip 26 are here assumed to be identical and the bottom edge strip 26 is assumed to be mirror symmetrical about a plane which is perpendicular to the channel 32 and cuts the bottom edge strip 26 midway along its length.

The end section 28*a* defines a receptacle or vessel 36*a* which is designed to receive the lower end portion 18*a* of the side edge strip 18 or the lower end portion 20*a* of the side edge strip 20. Likewise, the end section 28*b* defines a receptacle or vessel 36*b* which is designed to receive the lower end portion 18*a* or the lower end portion 20*a*. The receptacles 36*a*,36*b* are open at the side 34*a* of the bottom edge strip 26, and the receptacles 36*a*,36*b* extend partway from the side 34*a* to the opposite side 34*b* of the bottom edge strip 26 so that the receptacles 36*a*,36*b* are closed at the side 34*b*.

The receptacle 36*a* has an interior 38*a* which is partially circumscribed by a peripheral wall 40*a* constituting part of the end section 28*a*. The peripheral wall 40*a* is interrupted at the junction of the end section 28*a* and the central section 30 where the channel 32 opens into the interior 38*a* of the receptacle 36*a*.

Similarly, the receptacle 36*b* has an interior 38*b* which is partially circumscribed by a peripheral wall 40*b* forming part of the end section 28*b*. The peripheral wall 40*b* is interrupted at the junction of the end section 28*b* and the central section 30 where the channel 32 opens into the interior 38*b* of the receptacle 36*b*.

FIG. 5 shows that the channel 32, the interior 38*a* of the receptacle 36*a* and the interior 38*b* of the receptacle 36*b* may all have the same depth D as measured from the side 34*a* of the bottom edge strip 26 to the side 34*b*.

The interiors 38*a*,38*b* of the receptacles 36*a*,36*b* are complementary to the lower end portions 18*a*,20*a* of the side edge strips 18,20. Thus, the shape and dimensions of the interiors 38*a*,38*b* in the view of FIG. 4, and the shape and dimensions of the lower end portions 18*a*,20*a* in a view such as that of FIG. 2, are essentially the same. Accordingly, the receptacles 36*a*,36*b* are designed to receive the lower end portions 18*a*,20*a* snugly, preferably with a friction fit.

One manner of preparing the cathode 10 for electrolysis is as follows:

The bottom edge strip 26 is mounted on the bottom edge 16 of the cathode 10 by inserting the bottom edge 16 in the channel 32 of the bottom edge strip 26. The bottom edge strip 26 is positioned with the receptacle 36*a* in the vicinity of the corner defined by the side edge 12 and the bottom edge 16 of the cathode 10 and with the receptacle 36*b* in the vicinity of the corner defined by the side edge 14 and the bottom edge 16.

The side edge strip 18 is mounted on the side edge 12 of the cathode 10 by inserting the side edge 12 in the channel 22 of the side edge strip 18. During mounting of the side edge strip 18 on the side edge 12, the lower end portion 18*a* of the side edge strip 18 is located above the bottom edge strip 26. After the side edge strip 18 has been mounted on the side edge 12, the receptacle 36*a* of the bottom edge strip 26 is aligned with the lower end portion 18*a*. The side edge strip 18 is then slid downward along the side edge 12 so that the lower end portion 18*a* enters the receptacle 36*a*.

The side edge strip 20 is now mounted on the side edge 14 of the cathode 10 by inserting the side edge 14 in the channel corresponding to the channel 22 of the side edge strip 18. While the side edge strip 20 is being mounted on the side edge 14, the lower end portion 20*a* of the side edge strip 20 is disposed above the bottom edge strip 26. Once the side edge strip 20 has been properly mounted on the side edge 14, the lower end portion 20*a* should be in alignment, or very nearly in alignment, with the receptacle 36*b* of the bottom edge strip 26. Following any adjustments necessary to align the receptacle 36*b* and the lower end portion 20*a*, the side edge strip 20 is moved downward along the side edge 14 to cause the lower end portion 20*a* to enter the receptacle 36*b*.

Once the end portions 18*a*,20*a* of the side edge strips 18,20 have been inserted in the respective receptacles, the areas where the end portions 18*a*,20*a* enter the receptacles 36*a*,36*b* are sealed. The sealing can be performed conventionally. However, the amount of sealing required is substantially less than for the corner protectors of the prior art. Thus, in the prior art, it is necessary to seal not only the areas where the end portions of the side edge strips enter the respective corner protectors but also the areas where a bottom edge strip of the same design as the side edge strips enters the respective corner protectors. Moreover, for each corner protector, it is necessary to seal along areas which extend from the bottom edge strip to the respective side edge strip.

Figure 8:
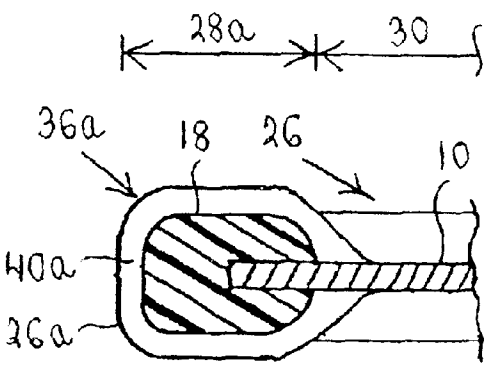
FIG. 8 is a fragmentary sectional view of the assembly of FIG. 7 as seen in the direction of the arrows VIII—VIII of FIG. 7.
Figure 7:
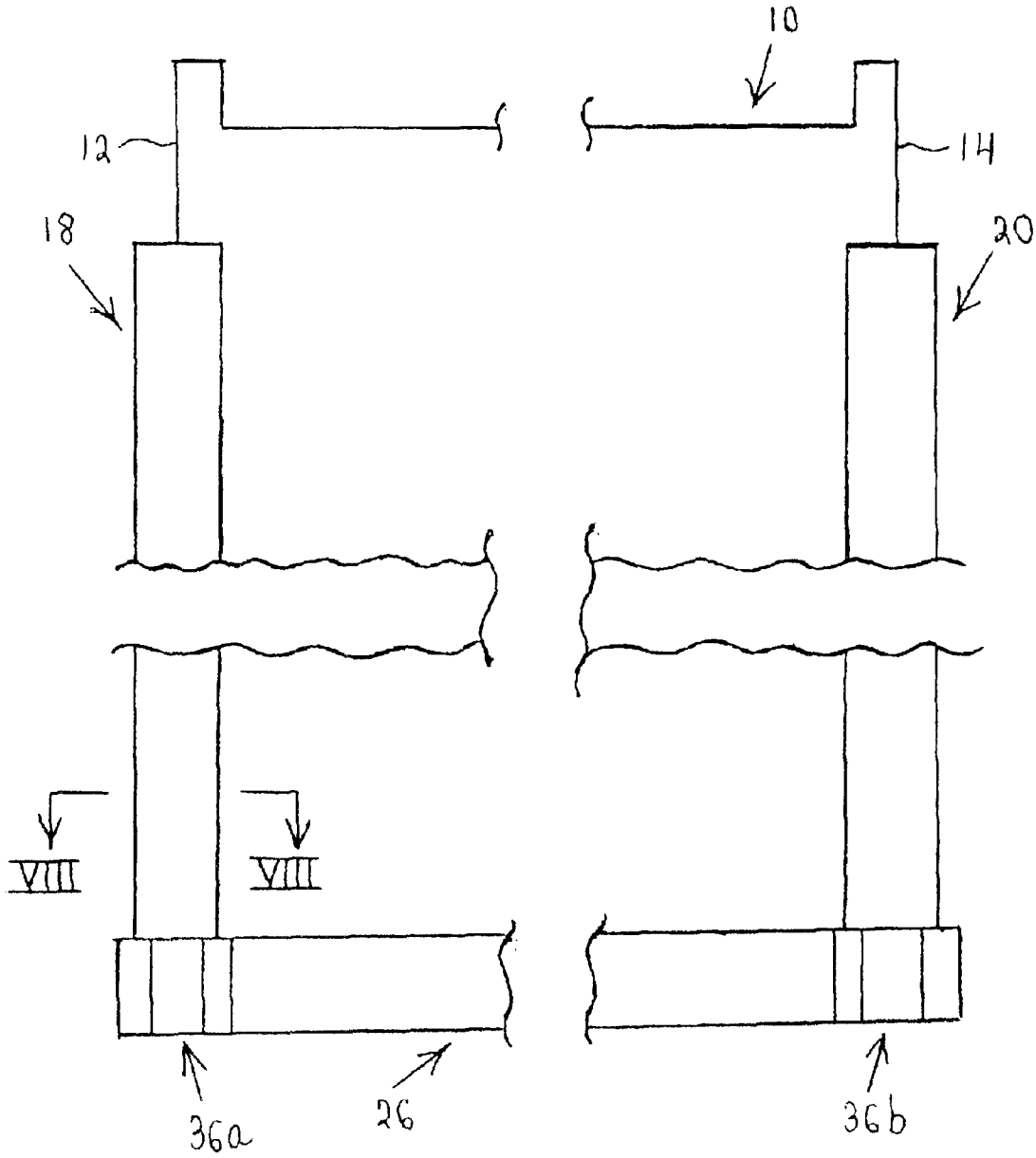
FIG. 7 is a fragmentary elevational view of the electrode of FIG. 1 with three edge protectors including that of FIG. 4.

FIG. 7 shows the cathode 10 with the bottom edge strip 26 on the lower edge 16, the side edge strip 18 on the side edge 12 and the side edge strip 20 on the side edge 14. The lower end portion 18*a* of the side edge strip 18 is received in the receptacle 36*a* of the bottom edge strip 26 while the lower end portion 20*a* of the side edge strip 20 is received in the receptacle 36*b* of the bottom edge strip 26. FIG. 8 shows the receptacle 36*a* with the lower end portion 18*a* of the side edge strip 18 inserted therein.

One way of making the bottom edge strip 26 is to extrude plastic into an elongated, one-piece, strip-like body having an appropriate cross-sectional shape and size. If the strip-like body has a length which substantially exceeds the length of the bottom edge 16 of the cathode 10, a segment slightly longer than the bottom edge 16 is cut from the strip-like body. The cut body segment may be machined externally to produce a shape such as that illustrated in FIGS. 4–6, for example. Each end of the cut body section is then drilled and/or milled to form the receptacles 36*a*,36*b*. Subsequently, the channel 32 is machined into the cut body segment.

Various modifications are possible within the meaning and range of equivalence of the appended claims.

I claim:

1. A protective sheath for use on an electrode having a first edge and a second edge which are transverse to one another, said protective sheath comprising:

a body including an elongated first section having a channel which extends longitudinally of said first section and is designed to receive at least a major part of the first edge of the electrode, said body further including a second section which is of one piece with said first section and defines a receptacle having a cross section larger than said channel for an end portion of another sheath designed to receive at least a major part of the second edge of the electrode.

2. The protective sheath of claim 1 for use where the electrode has an additional edge which runs transverse to the first edge, wherein said body includes an additional section which is of one piece with said first section and defines an additional receptacle for an end portion of an additional sheath designed to receive at least a major part of the additional edge of the electrode.

3. The protective sheath of claim 2, wherein said channel bridges said receptacles.

4. The protective sheath of claim 1, wherein said first section has two ends and said receptacle is located at one of said ends.

5. The protective sheath of claim 1, wherein said receptacle has an interior with a cross section which is substantially complementary to the cross section of a sheath designed to receive at least a major part of the second edge of the electrode.

6. The protective sheath of claim 1, wherein said channel opens into said receptacle.

7. The protective sheath of claim 1, wherein said body has a first side and an opposite second side, said channel and said receptacle each being open at said first side and closed at said second side.

8. An arrangement for use in electrolysis comprising:

an electrode having a first edge and a second edge which are transverse to one another;

a first sheath mounted on said first edge and receiving at least a major part thereof; and a second sheath mounted on said second edge and including an elongated first section having a channel which extends longitudinally of said first section and receives at least a major part of said second edge, said second sheath further including a second section of one piece with said first section and defining a receptacle having a cross section larger than said channel and which receives an end portion of said first sheath.

9. The arrangement of claim 8, wherein said electrode has an additional edge which runs transverse to said first edge; and further comprising an additional sheath which is mounted on said additional edge and receives at least a major part thereof, said second sheath including an additional section of one piece with said first section and defining an additional receptacle which receives an end portion of said additional sheath.

10. The arrangement of claim 9, wherein said channel bridges said receptacles.

11. The arrangement of claim 8, wherein said first section has two ends and said second section is located at one of said ends.

12. The arrangement of claim 8, wherein said receptacle has an interior with a cross section which is substantially complementary to the cross section of said end portion of said first sheath.

13. The arrangement of claim 8, wherein said channel opens into said receptacle.

14. The arrangement of claim 8, wherein said second sheath has a first side and an opposite second side, said channel and said receptacle each being open at said first side and closed at said second side.

15. A method of making a protective sheath for an electrode having a first edge and a second edge which are transverse to one another, said method comprising the steps of:

providing a body;

forming a channel in said body designed to receive at least a major part of the first edge of the electrode; and forming a receptacle having a cross section larger than said channel in said body for an end portion of another sheath designed to receive at least a major part of the second edge of the electrode.

16. The method of claim 15 for use where the electrode has an additional edge which runs transverse to the first edge, further comprising the step of forming an additional receptacle in said body for an end portion of an additional sheath designed to receive at least a major part of the additional edge of the electrode.

17. The method of claim 15, wherein the step of forming said receptacle comprises providing said receptacle with an interior having a cross section which is substantially complementary to the cross section of a sheath designed to receive at least a major part of the second edge of the electrode.

18. A method of preparing an electrode for use in electrolysis, said electrode having a first edge and a second edge which are transverse to one another, and said method comprising the steps of:

placing a first sheath on said first edge so that said first sheath receives at least a major part of said first edge;

placing a second sheath on said second edge so that said second sheath receives at least a major part of said second edge; and inserting an end portion of said first sheath in said second sheath said second sheath having a receptacle of a larger cross section than said end portion of said first sheath.

19. The method of claim 18, wherein said electrode has an additional edge which runs transverse to said second edge; and further comprising the steps of placing an additional sheath on said additional edge so that said additional sheath receives at least a major part of said additional edge, and inserting an end portion of said additional sheath in said second sheath.

* * * * *